US012408695B2

(12) United States Patent
Kim

(10) Patent No.: US 12,408,695 B2
(45) Date of Patent: Sep. 9, 2025

(54) COATING COMPOSITION OF LOW IGNITION PROPENSITY CIGARETTE PAPER, SMOKING ARTICLE USING THE SAME, AND METHOD OF MANUFACTURING THE LOW IGNITION PROPENSITY CIGARETTE PAPER

(71) Applicant: KT&G CORPORATION, Daejeon (KR)

(72) Inventor: Young Sin Kim, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 636 days.

(21) Appl. No.: 17/431,511

(22) PCT Filed: Mar. 8, 2021

(86) PCT No.: PCT/KR2021/002803
§ 371 (c)(1),
(2) Date: Aug. 17, 2021

(87) PCT Pub. No.: WO2021/221290
PCT Pub. Date: Nov. 4, 2021

(65) Prior Publication Data

US 2022/0369696 A1 Nov. 24, 2022

(30) Foreign Application Priority Data

Apr. 29, 2020 (KR) ..... 1020200052564

(51) Int. Cl.
*A24D 1/02* (2006.01)
*A24B 15/28* (2006.01)
(Continued)

(52) U.S. Cl.
CPC ..... *A24D 1/025* (2013.01); *A24B 15/282* (2013.01); *A24B 15/32* (2013.01); *A24B 15/406* (2013.01)

(58) Field of Classification Search
CPC ..... A24D 1/02; A24D 1/025
See application file for complete search history.

(56) References Cited

U.S. PATENT DOCUMENTS 6,325,859 B1 * 12/2001 De Roos ..... A24B 15/283 426/294
2007/0246055 A1 10/2007 Oglesby
(Continued)

FOREIGN PATENT DOCUMENTS

CN 102839563 A 12/2012
EP 1 321 048 A1 6/2003
(Continued)

OTHER PUBLICATIONS

TW201229153A Espacenet English Translation (Year: 2024).*
(Continued)

*Primary Examiner* — Eric Yaary
(74) *Attorney, Agent, or Firm* — Sughrue Mion, PLLC

(57) ABSTRACT

Provided herein are a coating composition of a low ignition propensity cigarette paper, a smoking article using the same, and a method of manufacturing the low ignition propensity cigarette paper. The coating composition of the low ignition propensity cigarette paper according to some embodiments of the present disclosure includes Arabic gum, ethanol, water, and fructo-oligosaccharide. Fructo-oligosaccharide may remarkably delay the aging speed of the coating composition and block even fine pores so that the ignition propensity of the coating composition is significantly reduced.

9 Claims, 5 Drawing Sheets

(51) Int. Cl.
*A24B 15/32* (2006.01)
*A24B 15/40* (2006.01)

(56) References Cited

U.S. PATENT DOCUMENTS

| | | | |
|---|---|---|---|
| 2009/0038629 | A1 | 2/2009 | Ergle et al. |
| 2012/0045553 | A1 | 2/2012 | Sengupta et al. |
| 2013/0152953 | A1 | 6/2013 | Mua et al. |
| 2014/0261503 | A1 | 9/2014 | Kim et al. |
| 2014/0271951 | A1 | 9/2014 | Mua et al. |

FOREIGN PATENT DOCUMENTS

| | | | | | |
|---|---|---|---|---|---|
| JP | 2015-501153 | A | | 1/2015 | |
| JP | 2016-511006 | A | | 4/2016 | |
| KR | 10-2013-0113959 | A | | 10/2013 | |
| KR | 10-2014-0014772 | A | | 2/2014 | |
| KR | 10-1534822 | B1 | | 7/2015 | |
| KR | 10-1926724 | A | | 3/2019 | |
| RU | 2 464 919 | C2 | | 10/2012 | |
| RU | 2 575 452 | C2 | | 2/2016 | |
| RU | 2 589 677 | C2 | | 7/2016 | |
| RU | 2 596 460 | C1 | | 9/2016 | |
| RU | 2 622 559 | C9 | | 10/2017 | |
| TW | 201229153 | A | * | 7/2012 | ..... B65D 65/42 |
| WO | 2019/031823 | A1 | | 2/2019 | |

OTHER PUBLICATIONS

Notification of Reason for Refusal dated Dec. 20, 2021 from the Korean Patent Office in Korean Application No. 10-2020-0052564.
Russian Office Action dated Dec. 13, 2021 from the Russian Patent Office in Russian Application No. 2021118242.
Extended European Search Report dated Apr. 21, 2022 from the European Patent Office in EP Application No. 21739896.5.
International Search Report for PCT/KR2021/002803 dated Jun. 28, 2021 [PCT/ISA/210].

* cited by examiner

[FIG. 1]
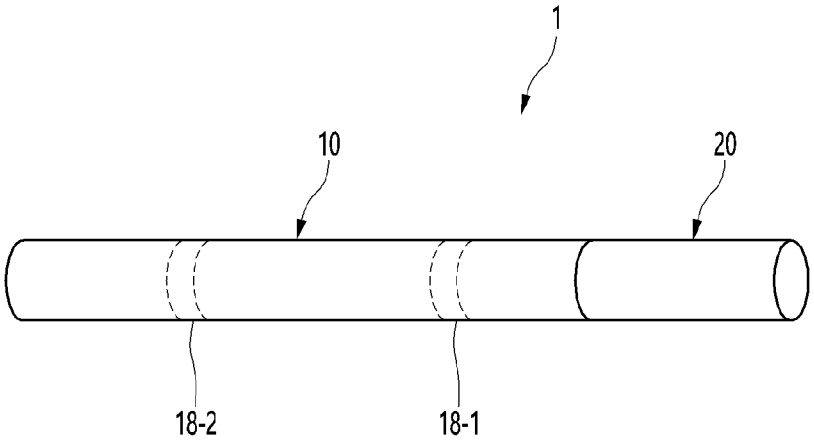
[FIG. 2]
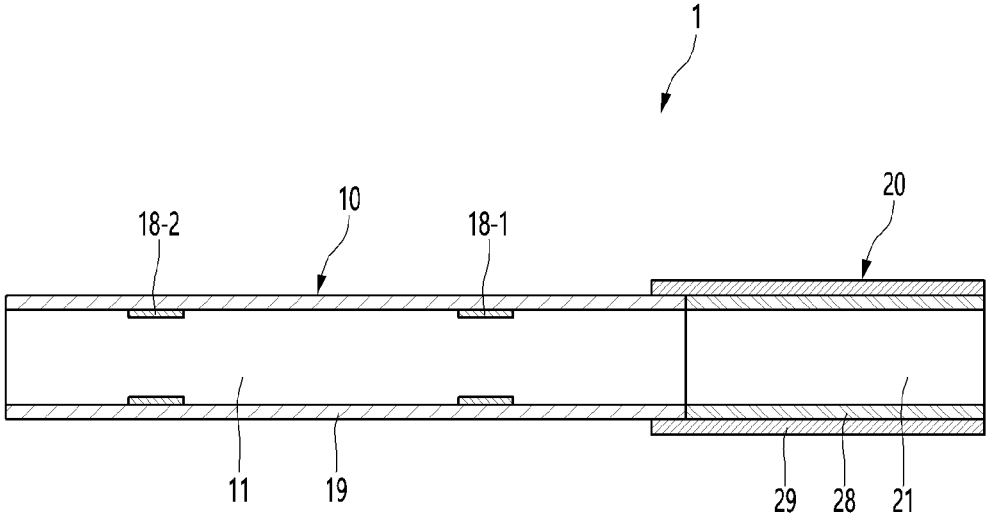

[FIG. 3]
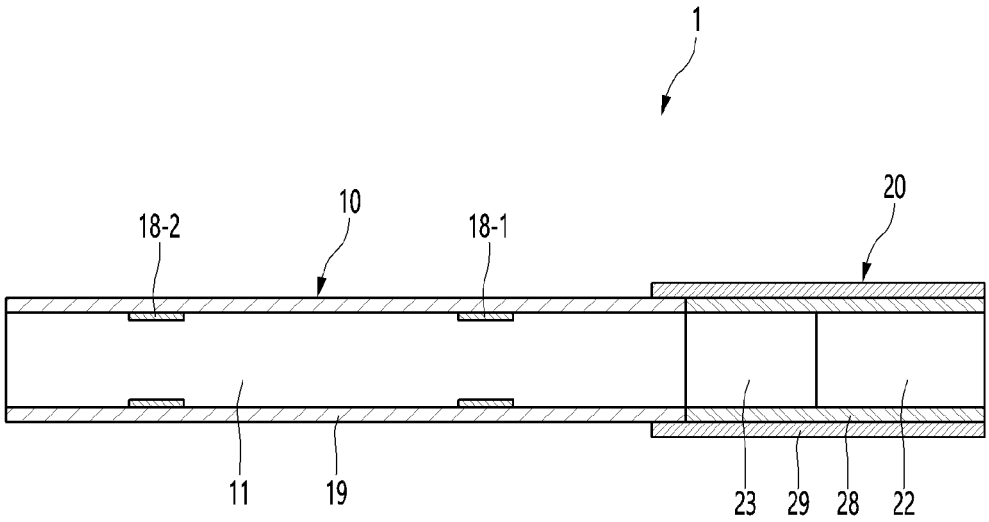
[FIG. 4]
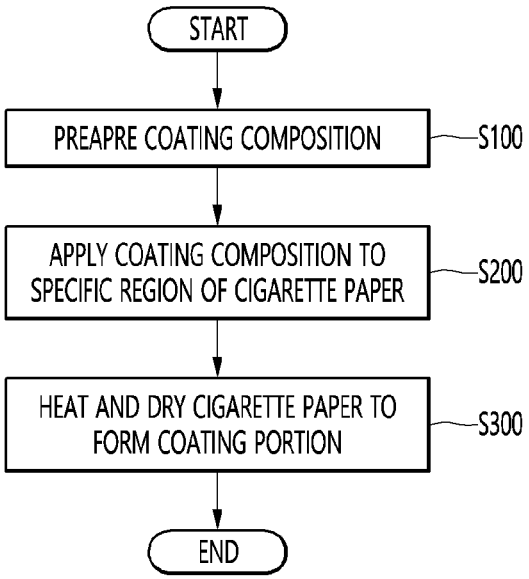

[FIG. 5]
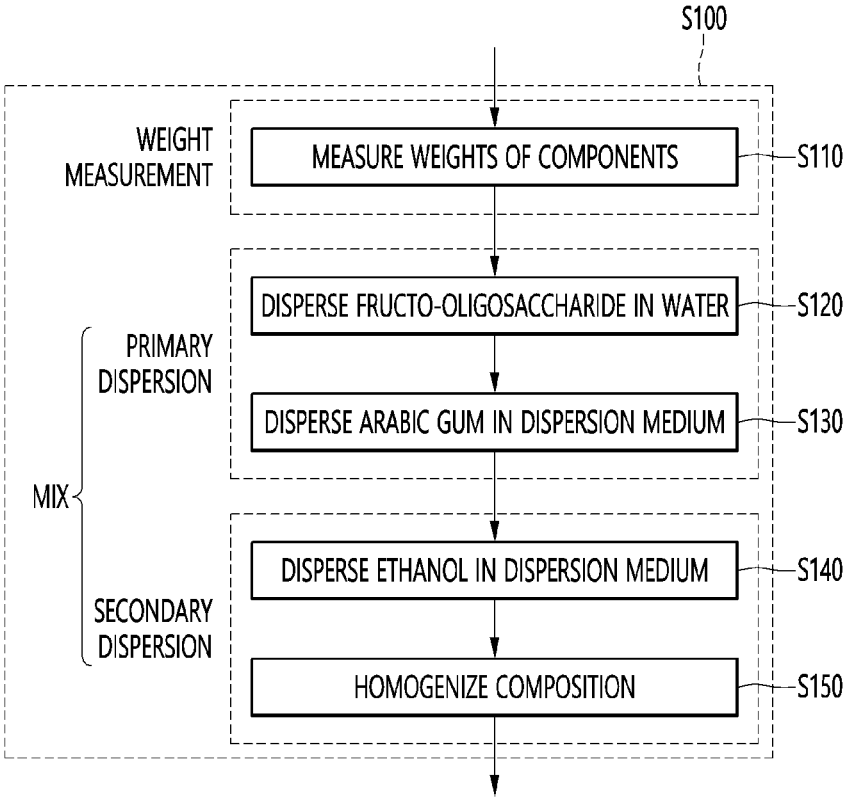

[FIG. 6]
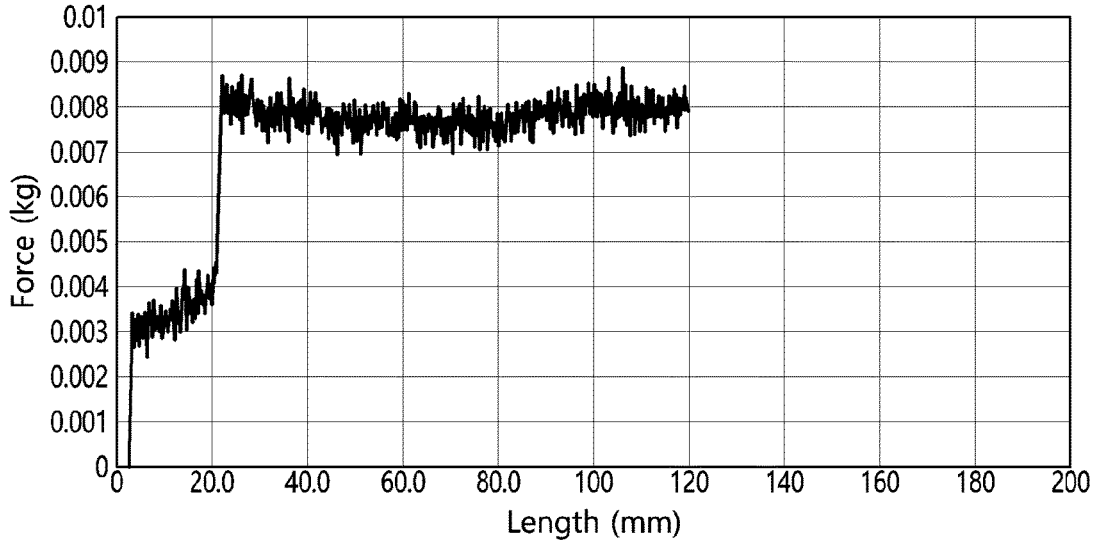
[FIG. 7]
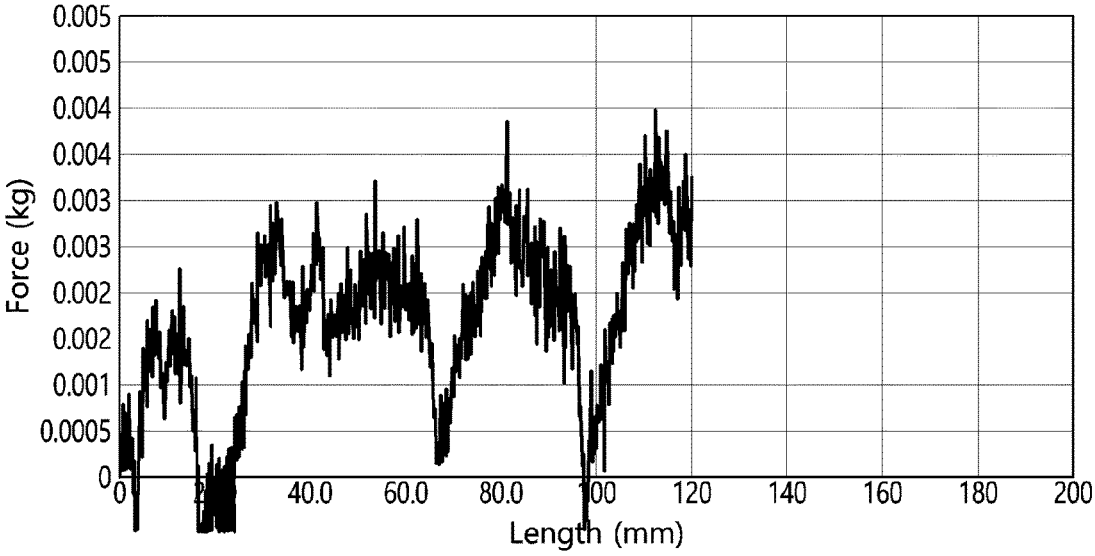

[FIG. 8]
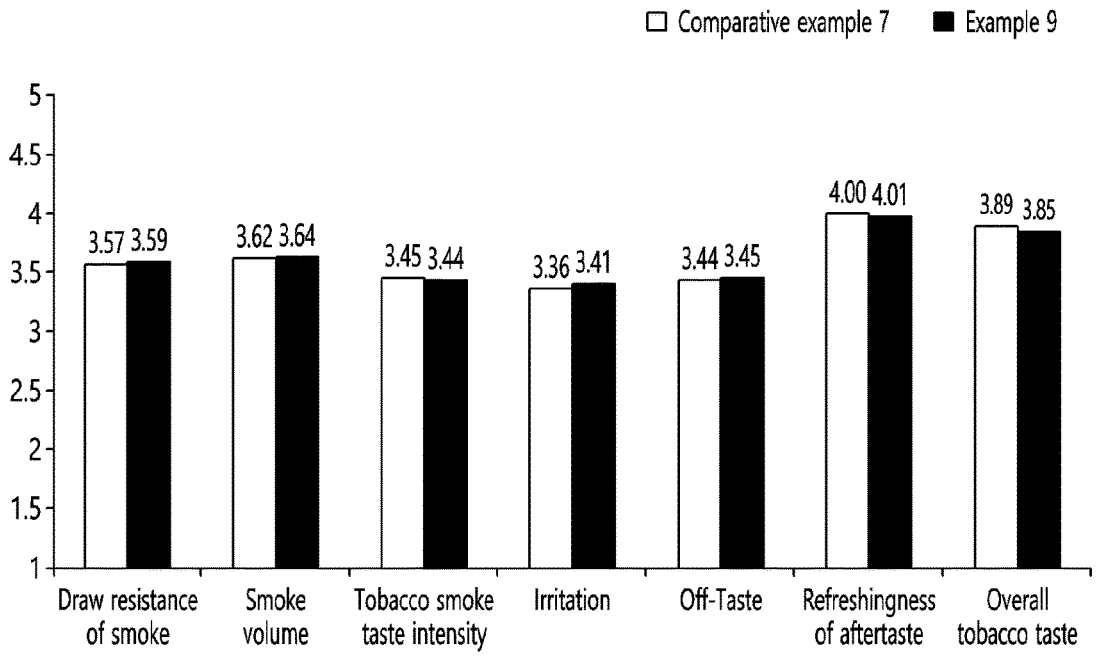

COATING COMPOSITION OF LOW IGNITION PROPENSITY CIGARETTE PAPER, SMOKING ARTICLE USING THE SAME, AND METHOD OF MANUFACTURING THE LOW IGNITION PROPENSITY CIGARETTE PAPER

CROSS REFERENCE TO RELATED APPLICATIONS

This application is a National Stage of International Application No. PCT/KR2021/002803 filed Mar. 8, 2021, claiming priority based on Korean Patent Application No. 10-2020-0052564 filed Apr. 29, 2020.

TECHNICAL FIELD

The present disclosure relates to a coating composition of a low ignition propensity cigarette paper, a smoking article manufactured using the same, and a method of manufacturing the low ignition propensity cigarette paper.

BACKGROUND ART

One of the main causes of fire is cigarette butts that are left unattended due to carelessness of smokers. In particular, in a case in which unextinguished cigarette butts are discarded in desolate places such as flower beds and mountains, the likelihood of a fire can drastically increase. Accordingly, in the tobacco industry, research on cigarette paper that decreases the combustibility of cigarettes to impart a self-extinguishing function thereto (so-called "low ignition propensity cigarette paper") has been actively carried out, and various attempts have been proposed.

For example, Korean Patent Application Publication No. 2013-0045157 proposes a method in which a coating composition made using alpha starch is applied to a cigarette paper to block the inflow of oxygen. However, a period during which the coating composition maintains its original properties may be less than two months due to the inherent aging properties of starch, and in a case in which the coating composition is exposed to low temperatures, the coating composition may rapidly age, and thus the usage period of the coating composition may be further shortened. Also, when the coating composition is dried at high temperatures, the ignition propensity of the coating composition may be increased, and when the coating composition is dried at room temperature, it may be difficult to dry the coating composition applied onto the cigarette paper. Further, a change in viscosity of the coating composition may be large in a dynamic state such as rotation, and thus, productivity and workability during the coating process may be degraded.

DISCLOSURE

Technical Problem

Some embodiments of the present disclosure are directed to providing a coating composition of a low ignition propensity cigarette paper that has an extended usage period and service life, a smoking article including the same, and a method of manufacturing the low ignition propensity cigarette paper.

Some embodiments of the present disclosure are also directed to providing a coating composition with reduced ignition propensity.

Some embodiments of the present disclosure are also directed to providing a coating composition capable of improving productivity and workability during manufacture of the low ignition propensity cigarette paper.

Objectives of the present disclosure are not limited to the above-mentioned objectives, and other unmentioned objectives should be clearly understood by those of ordinary skill in the art to which the present disclosure pertains from the description below.

Technical Solution

A coating composition according to some embodiments of the present disclosure includes Arabic gum, ethanol, water, and fructo-oligosaccharide.

In some embodiments, the Arabic gum may be included in an amount in a range of 10 wt % to 30 wt %, the ethanol may be included in an amount in a range of 15 wt % to 30 wt %, and the water may be included in an amount in a range of 10 wt % to 40 wt %.

In some embodiments, the fructo-oligosaccharide may be included in an amount in a range of 5 wt % to 35 wt %.

In some embodiments, a viscosity of the coating composition may be higher than or equal to 20 cPs and less than 1,000 cPs.

A coating composition according to some other embodiments of the present disclosure includes Arabic gum, ethanol, water, and galacto-oligosaccharide.

In some embodiments, the Arabic gum may be included in an amount in a range of 10 wt % to 30 wt %, the ethanol may be included in an amount in a range of 15 wt % to 30 wt %, the water may be included in an amount in a range of 10 wt % to 40 wt %, and the galacto-oligosaccharide may be included in an amount in a range of 5 wt % to 35 wt %.

A low ignition propensity cigarette paper according to some embodiments of the present disclosure may include one or more coating portions formed by the coating composition.

A method of manufacturing a low ignition propensity cigarette paper according to some embodiments of the present disclosure includes preparing a coating composition including fructo-oligosaccharide or galacto-oligosaccharide, applying the coating composition to a specific region of the cigarette paper, and heating and drying the cigarette paper, to which the coating composition is applied, such that a coating portion is formed.

A smoking article according to some embodiments of the present disclosure includes a smoking material portion including a cigarette paper which includes one or more coating portions formed using a coating composition including fructo-oligosaccharide or galacto-oligosaccharide and a smoking material which is wrapped with the cigarette paper, and a filter portion.

In some embodiments, the coating portion may include a first coating portion and a second coating portion, the smoking material portion may include a first segment disposed within a predetermined distance from an end portion adjacent to the filter portion and a second segment disposed at a greater distance therefrom than the first segment, the first coating portion may be formed in a region of the cigarette paper that corresponds to the first segment, and the second coating portion may be formed in a region of the cigarette paper that corresponds to the second segment. Here, an amount of the coating composition included in the first coating portion may be larger than an amount of the coating composition included in the second coating portion.

Advantageous Effects

According to various embodiments of the present disclosure, the usage period and service life of a coating composition of a low ignition propensity cigarette paper can be extended, and a period during which a viscosity of the coating composition of the low ignition propensity cigarette paper is maintained under room temperature and low-temperature conditions can also be extended. Further, since a dynamic viscosity maintenance rate of the coating composition of the low ignition propensity cigarette paper can be improved and the coating amount can be maintained to be constant during coating on the cigarette paper, productivity and workability can be improved.

Also, since drying at room temperature is possible, manufacturing costs can be reduced, and manufacturing time can be shortened.

Further, since fructo-oligosaccharide or galacto-oligosaccharide blocks even fine pores of the cigarette paper, the ignition propensity of the coating composition can be significantly reduced.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is a perspective view of a smoking article according to some embodiments of the present disclosure.

FIGS. 2 and 3 are cross-sectional views of the smoking article according to some embodiments of the present disclosure.

FIGS. 4 and 5 are exemplary flowcharts illustrating a method of manufacturing a low ignition propensity cigarette paper according to some embodiments of the present disclosure.

FIGS. 6 and 7 illustrate results of measuring an adhesive force according to Experimental Example 3.

FIG. 8 illustrates results of sensory evaluation according to Experimental Example 7.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various different forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the possibility of the presence or addition of one or more components, steps, operations, and/or devices other than those mentioned.

First, some terms used in the specification will be clarified.

In the specification, "smoking article" may refer to any product that can be smoked or any product that can provide a smoking experience, regardless of whether the product is based on tobacco, tobacco derivatives, expanded tobacco, reconstituted tobacco, or tobacco substitutes. For example, smoking articles may include products that can be smoked, such as a cigarette, a cigar, and a cigarillo.

In the specification, "smoking material" may refer to any material that may be used in smoking articles. For example, the smoking material may include a tobacco material.

In the specification, "upstream" or "upstream direction" may refer to a direction moving away from an oral region of a smoker, and "downstream" or "downstream direction" may refer to a direction approaching the oral region of the smoker. The terms "upstream" and "downstream" may be used to describe relative positions of components constituting a smoking article. For example, in a smoking article 1 illustrated in FIG. 1, a smoking material portion 10 is disposed upstream of a filter portion 20, and the filter portion 20 is disposed downstream of the smoking material portion 10.

In the specification, "longitudinal direction" may refer to a direction corresponding to a longitudinal axis of a smoking article.

Hereinafter, various embodiments of the present disclosure will be described in detail with reference to the accompanying drawings.

FIG. 1 is a perspective view of the smoking article 1 according to some embodiments of the present disclosure, and FIGS. 2 and 3 are cross-sectional views of the smoking article 1. Hereinafter, the smoking article 1 will be described with reference to FIGS. 1 to 3.

The smoking article 1 may include the smoking material portion 10 which is configured to combust and the filter portion 20 which is configured to filter smoke and/or an aerosol. However, only the components relating to the embodiment of the present disclosure are illustrated in FIGS. 1 to 3. Therefore, those of ordinary skill in the art to which the present disclosure pertains should understand that the smoking article 1 may further include general-purpose components other than the components illustrated in FIGS. 1 to 3.

The smoking material portion 10 and the filter portion 20 may be connected by a tipping paper 29. A circumference of the smoking article 1 may be in a range of about 5 mm to about 30 mm but is not limited thereto. In some embodiments, the filter portion 20 may be omitted.

The smoking material portion 10 may include a smoking material 11 and a cigarette paper 19 wrapped around the smoking material 11. The smoking material 11 may include various kinds of materials that generate smoke and/or an aerosol or are used in smoking. The smoker may generate smoke and/or an aerosol through the smoking article 1, and the generated smoke and/or aerosol may be inhaled into the oral region of the smoker through the filter portion 20.

For example, the smoking material 11 may include a tobacco material. For example, the tobacco material may include pieces of tobacco leaves, tobacco stems, and materials obtained by processing the same. As a more specific example, the tobacco material may include ground tobacco leaves, ground reconstituted tobacco, expanded shredded tobacco, expanded tobacco midribs, reconstituted tobacco leaves, and the like.

In some embodiments, the smoking material 11 may further include an additive such as a wetting agent, a flavoring agent, and/or organic acid. For example, the wetting agent may include at least one of glycerin, propylene glycol, ethylene glycol, dipropylene glycol, diethylene glycol, triethylene glycol, tetraethylene glycol, and oleyl alcohol. The wetting agent may maintain moisture in the tobacco material at an optimum level and thus soften the inherent flavor and produce a large amount of vapor. Also, for example, the flavoring agent may include licorice, saccharose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, a clove extract (or a clove material), coffee, or the like.

Next, the filter portion 20 may include a filter member 21 and a filter wrapping paper 28 wrapped around the filter member 21. The filter portion 20 may include one or more filter members. For example, as illustrated in FIG. 2, the filter portion 20 may include a single filter member 21. The filter member 21 may be made of acetate tow, paper, or the like. As another example, as illustrated in FIG. 3, the filter portion 20 may be implemented with a multi-layer filter including two or more filter members 22 and 23. In addition, the filter portion 20 may also include three or more filter members.

The filter portion 20 may include an adsorbent, a flavoring agent, or the like. For example, the adsorbent may be activated carbon or the like, and the flavoring agent may be an herb-flavored material or the like. However, the present disclosure is not limited thereto. In the multi-layer filter, one or more filter members may include at least one of the adsorbent and flavoring agent. For example, referring to FIG. 3, at least one of the first filter member 22 and the second filter member 23 may include at least one of the adsorbent and flavoring agent.

In some embodiments, the filter portion 20 may also include a cavity formed between the first filter member 22 and the second filter member 23. In such a case, a capsule including a flavoring agent may be disposed in the cavity. Also, in some embodiments, the flavoring agent may be porous flavoring granules manufactured in the form of solidified granules. The porous flavoring granules may suppress the volatility of the flavoring material and thus improve the flavor retaining property.

Next, the cigarette paper 19 may include one or more coating portions 18-1 and 18-2. A predetermined coating composition may be applied to the coating portions 18-1 and 18-2 to lower the porosity of the cigarette paper 19. Accordingly, when combustion of the smoking article 1 reaches the coating portions 18-1 and 18-2, an amount of oxygen entering the smoking material portion 10 may decrease, and the smoking article 1 may be self-extinguished. Hereinafter, for convenience of description, reference numeral "18" will be used to refer to any one coating portion 18-1 or 18-2 or collectively refer to the coating portions 18-1 and 18-2.

As illustrated in FIG. 1, the coating portion 18 may be in the form of a band, but the scope of the present disclosure is not limited thereto, and the form of the coating portion 18 may vary according to embodiments. Further, the number of coating portions 18 and the thickness and shape thereof may also be modified in various ways, and intervals at which the plurality of coating portions 18 are disposed may also be modified in various ways.

For example, the coating composition may be applied to the cigarette paper 19 having a porosity in a range of about 10 CU to about 100 CU, and per each smoking article 1, two coating portions 18-1 and 18-2 may be disposed between a point that is 15 mm from an end of the smoking material portion 10 and a point that is 5 mm from the filter portion 20. An interval between the coating portions 18-1 and 18-2 may be in a range of about 5 mm to about 10 mm.

Also, for example, the porosity of the cigarette paper 19 may be in a range of about 10 CU to about 100 CU, and the porosity of the coating portion 18 may be in a range of about 3 CU to about 20 CU. A thickness of a base paper of the cigarette paper 19 may be in a range of about 30 μm to about 100 μm, and a basis weight of the base paper may be in a range of about 15 $g/m^2$ to 80 $g/m^2$. The thickness of the coating portion 18 may be less than or equal to about 5 m, and the basis weight of the coating portion 18 may be less than or equal to about 15 $g/m^2$. A weight ratio of the coating composition with respect to the total weight of the cigarette paper 19 and the coating composition may be less than or equal to about 40 wt %.

Also, for example, in a case in which the coating portion 18 is in the form of a band, the mass of the coating composition per one band may be less than or equal to about 2.5 mg.

Also, for example, as illustrated in FIGS. 1 to 3, two or more coating portions 18-1 and 18-2 may be formed in the cigarette paper 19. As a more specific example, the first coating portion 18-1 may be formed in a region of the cigarette paper that corresponds to a first segment of the smoking material portion 10, and the second coating portion 18-2 may be formed in a region of the cigarette paper that corresponds to a second segment of the smoking material portion 10. Here, the first segment is a segment disposed within a predetermined distance from an end portion adjacent to the filter portion 20 (that is, a downstream end portion) and may be combusted at an end of smoking. Also, the second segment is a segment disposed at a greater distance from the filter portion 20 than the first segment and may be a smoking segment in which the smoking material burns. In such a case, the second coating portion 18-2 may serve to reduce the likelihood of fire when the smoking article 1 is discarded in the middle of smoking, and the first coating portion 18-1 may serve to guarantee the self-extinguishing function after the end of smoking. However, in some cases, the second coating portion 18-2 may block pores of the cigarette paper 19 during smoking and may degrade combustibility and tobacco taste.

In order to address such a problem, according to some embodiments of the present disclosure, at least one of basis weight, thickness, size, the number, the amount of the coating composition, and viscosity of the coating composition may be designed to be different between the first coating portion 18-1 and the second coating portion 18-2. For example, the second coating portion 18-2 may have a lower basis weight, a smaller thickness, or a smaller size than the first coating portion 18-1. As a more specific example, the basis weight of the first coating portion 18-1 may be in a range of about 2.6 $g/m^2$ to about 5.5 $g/m^2$, and the basis weight of the second coating portion 18-2 may be in a range of about 0.5 $g/m^2$ to 2.5 $g/m^2$. Here, the basis weight of the coating portion 18 is a basis weight of only the coating layer formed by applying the coating composition and may correspond to a difference between the basis weight of the coating layer and the base paper and the basis weight of the base paper without the coating layer. As another example, the number of second coating portions 18-2 (e.g., the number of bands) may be less than the number of first coating portions 18-1, or the amount of coating composition included in the second coating portion 18-2 may be less than the amount of coating composition included in the first coating portion 18-1. As still another example, the viscosity of the coating composition included in the second coating portion 18-2 may be lower than the viscosity of the coating composition included in the first coating portion 18-1. This is because the effect of blocking pores may be weakened with a decrease in the viscosity of the coating composition.

Alternatively, a combustion improver may be applied to the region of the cigarette paper in which the second coating portion 18-2 is formed or the region of the cigarette paper that corresponds to the second segment. In this way, a decrease in combustibility may be prevented in the vicinity of the second coating portion 18-2. Examples of the combustion improver may include alkali metal salts, alkaline earth metal salts, or a mixture thereof and, more specifically, may include carboxylic acid salts, acetates, citrates, malates, lactates, tartrates, carbonates, formates, propionates, glycolates, fumarates, oxalates, malonates, succinates, nitrates, phosphates, or a mixture thereof and potassium citrate, sodium citrate, potassium succinate, sodium succinate, or a mixture thereof. However, the examples of the combustion improver are not limited thereto.

According to the embodiments described above, by increasing the ignition propensity of the second coating portion 18-2, combustibility and tobacco taste during smoking may be guaranteed. Further, by reducing the ignition propensity of the first coating portion 18-1, self-extinguishing may be guaranteed at the end of smoking.

Also, in some embodiments, a sound-generating material may be added to a position close to the filter portion 20. For example, the sound-generating material may be added to the inside of the smoking material portion 10, the cigarette paper 19, or the first coating portion 18-1 that is adjacent to the filter portion 20. The sound-generating material may refer to a material from which sound is generated when the material burns, and examples thereof may include a clove material and a polysaccharide material. Also, the polysaccharide material may include, for example, starch. Through long research, the inventors of the present disclosure have found that a polysaccharide material is a sound-generating material. More specifically, the inventors found that, when the polysaccharide material having density or crystallite size higher/larger than or equal to a predetermined value burns, sound is generated as the crystal structure breaks. Since the polysaccharide material such as starch is a material proven to be safe, the polysaccharide material has an advantage of being applicable to smoking articles without limitation. The polysaccharide material may be processed into the form of particles, a sheet, a three-dimensional object, or the like and then added to the smoking material portion 10, but the scope of the present disclosure is not limited thereto. According to the embodiment, since sound is generated at a smoking end time point, an effect of notifying the smoker of the smoking end time point can be achieved. Also, even when the smoking article 1 is carelessly thrown away, since the sound attracts attention of nearby people, an effect of reducing the likelihood of fire can be achieved.

The smoking article 1 according to some embodiments of the present disclosure has been described above with reference to FIGS. 1 to 3. Hereinafter, a method of preparing the coating composition used in the smoking article 1 and a method of manufacturing the low ignition propensity cigarette paper 19 using the coating composition will be described.

The coating composition according to some embodiments may include Arabic gum, ethanol, water, and fructo-oligosaccharide.

The coating composition according to some other embodiments may include Arabic gum, ethanol, water, and galacto-oligosaccharide.

The coating composition according to still some other embodiments may include Arabic gum, ethanol, water, fructo-oligosaccharide, and galacto-oligosaccharide. Hereinafter, each component constituting the coating composition will be described.

Arabic gum may be prepared by drying and desalinating sap of gum Arabic trees. Arabic gum may block pores included in the cigarette paper 19 to block the supply of oxygen so that the coating composition is implemented to have low ignition propensity.

Arabic gum may have a relatively low viscosity even at high concentrations, and thus controlling the concentration of Arabic gum in a state in which Arabic gum has a low viscosity may be facilitated. Therefore, a coating composition having properties of low viscosity and high concentration may be prepared, and the intensity of combustion may be easily controlled through controlling the coating concentration of the coating composition.

Since Arabic gum may have high solubility in water, dispersion stability of the coating composition may be improved, and thus, a coating portion 18 having a uniform composition and concentration may be formed. Also, since the coating composition including Arabic gum dries more quickly at high temperatures than a conventional coating composition, workability of the coating (application) process may be improved.

Arabic gum may reduce an aging phenomenon, and thus the usage period, storage period, viscosity maintenance period, or service life of the coating composition including Arabic gum may be extended as compared to a conventional coating composition including alpha starch. Also, a dynamic viscosity maintenance rate in a dynamic situation in which a coating roller operates may be improved, and a change in viscosity that may occur in a low-temperature environment of about 2° C. may be significantly reduced.

Also, since Arabic gum has excellent heat resistance, the performance of Arabic gum may be maintained even under high temperature conditions, and an occurrence of off-flavor during combustion in a drying process may be reduced.

In some embodiments, with respect to the total coating composition, Arabic gum may be included in an amount in a range of about 10 wt % to about 30 wt %. Within this range, the dispersion stability of the coating composition may be improved, the drying speed may be increased, the workability of the coating process may be further improved, the low-viscosity maintenance period may be significantly extended, the viscosity maintenance rate may be remarkably improved, and the aging phenomenon may be reduced such that the service life is extended.

Next, fructo-oligosaccharide may block the supply of oxygen by blocking the pores included in the cigarette paper 19, and in this way, like Arabic gum, fructo-oligosaccharide may reduce the ignition propensity of the coating composition. Since an average size of fructo-oligosaccharide is smaller than that of Arabic gum, fructo-oligosaccharide may block fine pores with a relatively small diameter or size to reduce the ignition propensity of the coating composition. Further, due to a small molecular weight, fructo-oligosaccharide has an effect of improving the dispersibility of the coating composition. Thus, since the coating composition may be uniformly applied to the cigarette paper 19, the workability of the coating process may be improved and the manufacturing time may be shortened.

Also, fructo-oligosaccharide may effectively lower the aging speed of Arabic gum and may remarkably delay the aging speed of the coating composition. Therefore, as compared to a conventional coating composition including alpha starch, the viscosity maintenance period may be extended, the viscosity maintenance rate may be improved, and a change in viscosity may be minimized even when the coating composition is exposed to a low temperature of about 2° C.

Also, fructo-oligosaccharide may be dissolved in ethanol, and in a case in which fructo-oligosaccharide is used together with ethanol, the viscosity of the coating composition may be decreased, and a bonding force between the components of the coating composition may be increased.

Also, the coating composition including fructo-oligosaccharide may dry more quickly at high temperatures than a conventional coating composition. Therefore, the coating composition according to the embodiment may improve the workability of the coating process.

In some embodiments, with respect to the total coating composition, fructo-oligosaccharide may be included in an amount in a range of about 5 wt % to about 35 wt %. Within this range, the low-viscosity maintenance period may be significantly extended, the viscosity maintenance rate may be remarkably improved, the aging phenomenon may be significantly reduced such that the service life is extended, and the workability of the coating process may be improved.

Galacto-oligosaccharide may have a percentage by weight similar to that of fructo-oligosaccharide and may have similar effects to fructo-oligosaccharide. In order to avoid repeated description, description of galacto-oligosaccharide will be omitted.

Next, ethanol may increase the solid content of the coating composition, and the content of ethanol may be controlled to control the viscosity of the coating composition.

Also, ethanol may decrease the surface tension of the coating composition to improve affinity between the coating roller and the coating composition during the coating process. In this way, since the coating amount may be increased and may be maintained to be constant, the workability of the coating process may be improved, and the ignition propensity may be reduced.

Also, ethanol may improve the dryability of the coating composition and may increase the drying speed at high temperatures. Thus, the workability of the coating process may be improved, and a phenomenon in which water is absorbed into the cigarette paper causing the strength thereof to decrease may be prevented.

In some embodiments, with respect to the total coating composition, ethanol may be included in an amount in a range of about 15 wt % to about 30 wt %. Within this range, the viscosity of the coating composition may be appropriately maintained, the workability of the coating process may be further improved such that productivity of manufacturing the smoking article is improved, and the ignition propensity of the smoking article may be further reduced.

Next, water may be used to control concentrations of other components in the coating composition or to control the concentration of the coating composition. Also, water may improve the absorbability of the coating composition into the cigarette paper 19.

In some embodiments, with respect to the total coating composition, water may be used in an amount in a range of about 10 wt % to about 40 wt %. Within this range, control of the concentration and viscosity of the coating composition may be further facilitated.

Various effects of the coating composition may be significantly more prominent when all the components of the coating composition are mixed as compared to when each of the components is present alone. Various effects described above may occur due to a combination of the components, and a synergistic effect may occur due to the combination of the components.

The coating composition of the low ignition propensity cigarette paper according to some embodiments may include about 10 wt % to about 30 wt % Arabic gum, about 5 wt % to about 35 wt % fructo-oligosaccharide (or galacto-oligosaccharide), about 15 wt % to about 30 wt % ethanol, and about 10 wt % to about 40 wt % water. Within these ranges, the usage period and service life of the coating composition may be further extended, and the viscosity maintenance period of the coating composition at room temperature (about 25° C.) and low-temperature (about 2° C.) may be significantly extended. Also, the dynamic viscosity maintenance rate, which indicates the viscosity maintenance rate of the coating composition when the coating composition is rotated at a predetermined rotational speed due to a rotating shaft, may be further improved. Also, within the ranges listed above, during the coating work on the cigarette paper, the amount of coating composition applied to the low ignition propensity cigarette paper may be increased, the coating composition may be uniformly applied, and dryability may be improved such that the workability of coating is improved.

In some embodiments, the coating composition may further include one or more of citric acid, tartaric acid, lactic acid, malic acid, and ascorbic acid. These materials may reduce spoilage and deterioration of the coating composition to extend the service life or storage period of the coating composition.

In some embodiments, the coating composition may further include one or more of sodium benzoate, sodium sorbate, grapefruit seed extract, and cinnamon extract. These materials may reduce spoilage and deterioration of the coating composition to extend the service life or storage period of the coating composition. Also, when these materials are used together with citric acid, tartaric acid, lactic acid, malic acid, ascorbic acid, or the like mentioned above, the service life of the coating composition may be further extended.

In some embodiments, the coating composition may further include one or more of xanthan gum, guar gum, amylopectin, and starch ester. Xanthan gum, guar gum, amylopectin, starch ester, and the like may help to lower the viscosity of the coating composition and improve the dispersibility of the components of the coating composition to extend the usage period of the coating composition.

Since the pores inside the cigarette paper 19 are filled with the coating composition, when the viscosity of the coating composition is too low, optical properties of the cigarette paper 19 may be degraded, and the ignition propensity of the cigarette paper 19 may be increased. Therefore, there is a need to appropriately control the viscosity of the coating composition, and preferably, the viscosity of the coating composition of the low ignition propensity cigarette paper according to the embodiment may be higher than or equal to about 20 cPs and lower than about 1,000 cPs. This is because, when the viscosity of the coating composition is lower than about 20 cPs, the whiteness and opacity of the cigarette paper 19 may decrease, a speed at which the coating composition permeates into the cigarette paper may increase (i.e., diffusion coefficient may increase) such that the amount of Arabic gum and fructo-oligosaccharide remaining on the surface of the cigarette paper may decrease, and accordingly, the pore blocking ability may be degraded or the ignition propensity may be increased. In addition, when the viscosity of the coating composition is lower than about 20 cPs, the dynamic viscosity maintenance rate of the coating composition may significantly decrease.

Here, in relation to the dynamic viscosity maintenance rate, the coating composition may be coated on the cigarette paper 19 using a rotary device such as a coating roller. In a case in which the viscosity of the coating composition changes under a dynamic condition such as when a rotational speed of the coating composition increases, the coating portion 18 may be formed at a non-uniform concentration causing the ignition propensity to increase, and the workability of the coating process may be degraded. Therefore, in order to stably perform coating, a change in the viscosity of the coating composition in a dynamic state should be minimized.

Even when the viscosity of the coating composition is too high, the dynamic viscosity maintenance rate may be degraded. For example, when the viscosity of the coating composition is higher than or equal to about 1,000 cPs, the dynamic viscosity maintenance rate of the coating composition may significantly decrease, and thus, the coating portion 18 may be formed with a non-uniform form and concentration, and the workability of the coating process may be degraded.

In a case in which the viscosity of the coating composition is controlled to be higher than or equal to about 20 cPs and less than about 1,000 cPs, the dynamic viscosity maintenance rate when the rotational speed of the coating composition increases from about 20 rpm to 100 rpm may be higher than or equal to about 84%, and a diffusion coefficient when the rotational speed of the coating composition increases from about 20 rpm to 100 rpm may be less than or equal to 0.15. Within these ranges, the process of coating the coating composition may be stably performed, the coating amount of the coating composition, which spreads into the cigarette paper 19, may increase, and the coating amount may be maintained to be constant.

Meanwhile, the strength of the cigarette paper is decreased upon contact with water. Therefore, after a conventional coating composition is coated on the cigarette paper, drying equipment is used to remove moisture. Here, the drying process may be mostly performed under high temperature conditions of higher than or equal to about 200° C. Thus, the costs and time for manufacturing the smoking article may be increased, and there is a concern that the coating composition may be deteriorated, e.g., the ignition propensity of the coating composition may be increased. Also, a conventional coating composition may not be dried under the room temperature condition (about 25° C.).

On the other hand, in the case of the coating composition according to the embodiment, due to excellent dryability, a drying speed under high temperature conditions may be relatively much higher than the drying speed of a conventional coating composition. Also, unlike a conventional coating composition, the coating composition according to the embodiment may also be dried under the room temperature condition. Therefore, separate drying equipment may not be required, and thus, the costs and time for manufacturing the smoking article may be reduced, and the properties of the coating composition may be maintained to be constant.

Hereinafter, a method of manufacturing a low ignition propensity cigarette paper according to some embodiments of the present disclosure will be described with reference to FIGS. 4 and 5.

FIG. 4 is an exemplary flowchart illustrating the manufacturing method.

As illustrated in FIG. 4, the manufacturing method according to the embodiment may start with preparing a coating composition (S100). A detailed process of the preparing of the coating composition (S100) is illustrated in FIG. 5.

As illustrated in FIG. 5, the preparing of the coating composition (S100) may include a weight measuring step (S110) and mixing steps (S120 to S150).

In the weight measuring step (S110), a weight of each component constituting the coating composition may be measured. Here, the viscosity of the coating composition may be increased in proportion to the extent to which the weight of Arabic gum, fructo-oligosaccharide, and ethanol is larger than the weight of water. Also, when a low ignition propensity coating composition is used, in order to ensure low ignition propensity and improve productivity such as dryability, a weight ratio of Arabic gum, fructo-oligosaccharide, ethanol, water, and the like, which are components of the coating composition, may be very important.

In the mixing steps (S120 to S150), the components may be mixed according to a preset composition ratio. The mixing steps (S120 to S150) may include primary dispersion steps S120 and S130 and secondary dispersion steps S140 and S150. Hereinafter, a process of each dispersion step will be described in detail.

The primary dispersion steps S120 and S130 may include dispersing fructo-oligosaccharide (S120) and dispersing Arabic gum (S130).

In step S120, fructo-oligosaccharide may be dispersed in water. That is, water may be used as a dispersion medium. Here, the temperature of water may be maintained to be in a range of about 25° C. to about 35° C., and in this range, fructo-oligosaccharide may be dispersed well. However, the scope of the present disclosure is not limited thereto.

More specifically, while water, which is a dispersion medium, is rotated, fructo-oligosaccharide may be input thereto. Here, a unit dispersion amount may be in a range of about 10 g/L/min to about 20 g/L/min, and a rotational speed of the dispersion medium may be in a range of about 17,000 rpm to about 20,000 rpm. Within these ranges, fructo-oligosaccharide may be uniformly dispersed in the dispersion medium.

In step S130, while the composition (i.e., dispersion medium) that has undergone step S120 is rotated, Arabic gum may be input thereto. Here, a unit dispersion amount may be in a range of about 10 g/L/min to about 20 g/L/min, and a rotational speed of the composition may be in a range of about 17,000 rpm to about 20,000 rpm. Within these ranges, Arabic gum may be uniformly dispersed in the composition.

Next, the secondary dispersion steps S140 and S150 may include dispersing ethanol (S140) and homogenizing (S150).

In step S140, ethanol may be dispersed in the dispersion medium that has undergone the primary dispersion steps S120 and S130. Here, the temperature of ethanol may be maintained to be in a range of about 25° C. to about 35° C., and in this range, ethanol may be dispersed well in the dispersion medium. However, the scope of the present disclosure is not limited thereto.

In step S150, the coating composition may be homogenized. This step may include a primary homogenization step and a secondary homogenization step.

The primary homogenization step is a step in which the composition is rotated at a speed in a range of about 250 rpm to about 350 rpm by utilizing equipment such as a double cruciform impeller so that the viscosity becomes uniform throughout the entire composition. Within the above range, Arabic gum and fructo-oligosaccharide may be uniformly dispersed in the dispersion medium, and the viscosity of the composition may be uniform. Here, the temperature of the composition may rise due to the rotation.

The secondary homogenization step is a step in which the temperature of the composition, which has undergone the primary homogenization step, is dropped to be lower than or equal to about 40° C. and the composition is rotated at a speed in a range of about 150 rpm to about 250 rpm by utilizing equipment such as a homomixer. Within the above ranges, Arabic gum and fructo-oligosaccharide may be uniformly dispersed in the dispersion medium, and the viscosity of the composition may be uniform.

Description will be continued by referring back to FIG. 4.

Next, a step of applying the coating composition on a specific region of the cigarette paper (S200) may be performed. For example, cigarette paper rolled into a roll may be supplied to a coating apparatus by a roller, and the coating composition may also be coated on the cigarette paper by the roller.

Next, a step of heating and drying the cigarette paper coated with the coating composition to form the coating portion 18 (S300) may be performed. For example, the cigarette paper on which the coating composition is applied may be heated and dried to form the coating portion 18 in the form of a band. The heating may be performed through a separate heating apparatus.

As described above, the number of coating portions 18 and the thickness and shape of the coating portion 18 may be modified in various ways, and the intervals at which the plurality of coating portions 18 are disposed may also be modified in various ways.

Hereinafter, the configurations and effects of the coating composition mentioned in the present disclosure will be described in more detail using examples and comparative examples. However, the following examples are only some examples of the present disclosure, and the scope of the present disclosure is not limited thereto.

Examples 1 to 4

Arabic gum, fructo-oligosaccharide (or galacto-oligosaccharide), ethanol, and water were measured and mixed according to the method described above with reference to FIG. 5 to prepare a coating composition. Also, coating compositions according to Examples 1 to 4 were prepared according to composition ratios shown in Table 1 below.

TABLE 1

| | Composition ratio of components (wt %) | | | | |
|---|---|---|---|---|---|
| Classification | Arabic gum | Fructo-oligosaccharide | Galacto-oligosaccharide | Ethanol | Water |
| Example 1 | 25 | 10 | | 15 | 50 |
| Example 2 | 25 | 20 | | 15 | 40 |
| Example 3 | 25 | 30 | | 15 | 30 |
| Example 4 | 25 | | 30 | 15 | 30 |

Comparative Examples 1 to 6

Coating compositions according to Comparative Examples 1 to 6 were prepared according to composition ratios shown in Table 2 below. The components shown in Table 2 below were measured and mixed using the same method as in Example 1 to prepare the coating compositions.

TABLE 2

| | Composition ratio of components (wt %) | | | | | |
|---|---|---|---|---|---|---|
| Classification | Arabic gum | Maltose | Maltodextrin | Starch | Ethanol | Water |
| Comparative Example 1 | 25 | 0 | 0 | 0 | 15 | 60 |
| Comparative Example 2 | 25 | 0 | 0 | 30 | 15 | 30 |
| Comparative Example 3 | 25 | 0 | 30 | 0 | 15 | 30 |
| Comparative Example 4 | 25 | 10 | 0 | 0 | 15 | 50 |
| Comparative Example 5 | 25 | 20 | 0 | 0 | 15 | 40 |
| Comparative Example 6 | 25 | 30 | 0 | 0 | 15 | 30 |

Experimental Example 1: Evaluation of Dynamic Viscosity Maintenance Rate of Coating Composition An experiment was conducted to evaluate a dynamic viscosity maintenance rate for the coating compositions according to Comparative Examples 1 to 3, Comparative Example 6, and Examples 3 and 4. In other words, an experiment was conducted to confirm whether the viscosity of the coating composition is maintained even when a coating roller rotates at a high speed, and the experimental results are shown in Table 3 below. The viscosity of the coating composition was measured on the basis of KS M ISO 2555.

TABLE 3

| Classification | Viscosity according to number of rotations (cPs) 20 rpm | 100 rpm | Dynamic viscosity maintenance rate (%) |
|---|---|---|---|
| Comparative Example 1 | 141 | 99 | 70 |
| Comparative Example 2 | 1950 | 1700 | 87 |
| Comparative Example 3 | 200 | 110 | 55 |
| Comparative Example 6 | 251 | 250 | 100 |
| Example 3 | 264 | 263 | 100 |
| Example 4 | 161 | 158 | 98 |

Referring to Table 3, it was found that the viscosity of the coating compositions according to Comparative Example 6 and Examples 3 and 4 hardly changed even during high-speed rotation (e.g., 100 rpm). This seems be the effect caused by maltose, fructo-oligosaccharide, and galacto-oligosaccharide included in each coating composition. In this way, it can be seen that, when maltose, fructo-oligosaccharide, and galacto-oligosaccharide are added in an appropriate ratio to the coating composition, the workability of the coating process is improved and the ignition propensity of the coating composition is reduced.

Experimental Example 2: In-Depth Evaluation of Dynamic Viscosity Maintenance Rate of Coating Composition An in-depth experiment was conducted for the dynamic viscosity maintenance rate. Specifically, an experiment was conducted to observe how fast the dynamic viscosity maintenance rate reaches the maximum value (e.g., about 100%) when the content of maltose or fructo-oligosaccharide is increased while the content of Arabic gum is fixed (refer to the composition ratios of Comparative Examples 4 to 6 and Examples 1 to 3). Since physical properties of galacto-oligosaccharide are very similar to those of fructo-oligosaccharide, the experiment was only conducted for fructo-oligosaccharide, and the experimental results are shown in Table 4 below.

TABLE 4

| Classification | Viscosity according to number of rotations (cPs) 20 rpm | 100 rpm | Dynamic viscosity maintenance rate (%) |
|---|---|---|---|
| Comparative Example 1 | 141 | 99 | 70 |
| Comparative Example 4 | 178 | 135 | 76 |
| Comparative Example 5 | 205 | 202 | 99 |
| Comparative Example 6 | 251 | 250 | 100 |
| Example 1 | 172 | 173 | 100 |
| Example 2 | 207 | 205 | 99 |
| Example 3 | 264 | 263 | 100 |

In Table 4, referring to the experimental results of Comparative Examples 4 to 6 relating to maltose, it was found that the dynamic viscosity maintenance rate reached 99% only when maltose was added in an amount larger than or equal to about 20 wt %. On the other hand, referring to the experimental results of Examples 1 to 3 relating to fructo-oligosaccharide, it was found that the dynamic viscosity maintenance rate reached 100% even when about 10 wt % fructo-oligosaccharide was added. This indicates that fructo-oligosaccharide is more effective in improving the dynamic viscosity maintenance rate of the coating composition than maltose.

Experimental Example 3: Evaluation of Adhesive Force of Coating Composition

The adhesive force of the coating composition to the cigarette paper is closely related to the quality of the smoking article and workability of manufacturing the smoking article. This is because, when the adhesive force to the cigarette paper is too high, a smoking material such as shredded tobacco may stick to a portion to which the coating composition is applied and the shredded tobacco may not be uniformly input, or shredded tobacco may form a mass on a specific portion and may not be input sufficiently. Therefore, an experiment was conducted to measure an adhesive force of the coating compositions according to Comparative Example 5 and Example 2. The adhesive force measurement was performed on the basis of KS M ISO 29864, and the experimental results are illustrated in FIGS. 6 and 7. FIGS. 6 and 7 illustrate results of measuring the adhesive force of the coating compositions according to Comparative Example 5 and Example 2.

Referring to FIGS. 6 and 7, it was found that the adhesive force of the coating composition according to Comparative Example 5 was much higher than the adhesive force of the coating composition according to Example 2. That is, it was found that, for the same amount of maltose and fructo-oligosaccharide, the adhesive force of the coating composition to which maltose is added exceeds the adhesive force of the coating composition to which fructo-oligosaccharide is added. This indicates that the fructo-oligosaccharide-based coating composition (e.g., according to Example 2) is more effective in improving the quality of the smoking article and the workability of manufacturing the smoking article than the maltose-based coating composition (e.g., according to Comparative Example 5).

Experimental Example 4: Evaluation of Workability of Smoking Article Manufacturing Process Additional evaluation was performed for the workability of a smoking article manufacturing process, in relation to the coating compositions according to Comparative Example 5 and Example 2. More specifically, while manufacturing a smoking article (e.g., a smoking article having two coating portions as illustrated in FIG. 1) using the coating compositions according to Comparative Example 5 and Example 2, an extent to which shredded tobacco sticks out from an end and a rate at which an insufficient input amount of shredded tobacco occurs were measured. Here, the extent to which shredded tobacco sticks out refers to an extent to which shredded tobacco sticks out from an end portion of the smoking article and was measured on the basis of ISO 3550-1. The measurement results are shown in Table 5 below.

TABLE 5

| Classification | Extent to which shredded tobacco sticks out (%) | Rate at which insufficient input amount occurs (%) |
|---|---|---|
| Comparative Example 5 | 0.22 | 0.34 |
| Example 2 | 0.08 | 0.15 |

Referring to Table 5, it was found that, in the coating composition according to Comparative Example 5, both the extent to which shredded tobacco sticks out and the rate at which an insufficient input amount occurs were higher as compared to Example 2. This shows that the adhesive force of the coating composition greatly affects the workability and quality failure rate (e.g., the rate at which an insufficient input amount occurs) of the actual smoking article manufacturing process and indicates that the fructo-oligosaccharide-based coating composition (e.g., according to Example 2) is more effective in improving the workability of the smoking article manufacturing process and the quality of the smoking article than the maltose-based coating composition (e.g., according to Comparative Example 5).

Experimental Example 5: Evaluation of Uniformity in Application of Coating Composition An experiment was conducted to evaluate uniformity in application of the coating compositions according to Comparative Example 5 and Example 2. More specifically, a sizing degree of a coating surface was measured using the Stöckigt test method based on KS M 7025 to evaluate the uniformity in application of the coating compositions, and the experimental results are shown in Table 6 below.

TABLE 6

| Classification | Sizing degree (s) |
|---|---|
| Comparative Example 5 | 1.2 |
| Example 2 | 2 |

Referring to Table 6, it was found that the coating composition according to Example 2 had a higher sizing degree than the coating composition according to Comparative Example 5. This indicates that the coating composition according to Example 2 is applied with higher uniformity as compared to Comparative Example 5. When the coating composition is uniformly applied, the ignition propensity may be reduced and workability may be improved. From this, it can be seen that the fructo-oligosaccharide-based coating composition (e.g., according to Example 2) is more effective in reducing the ignition propensity and improving the workability than the maltose-based coating composition (e.g., according to Comparative Example 5).

Examples 5 to 17

Coating compositions were prepared according to composition ratios shown in Table 7 below (the preparation method is the same as in the previous examples), and the prepared coating compositions were used to manufacture smoking articles according to Examples 5 to 17. The smoking articles according to Examples 5 to 17 were manufactured to have two coating portions like the smoking article 1 illustrated in FIG. 1.

TABLE 7

| Classification | Composition ratio of components (wt %) | | | | |
|---|---|---|---|---|---|
| | Arabic gum | Fructo-oligosaccharide | Galacto-oligosaccharide | Ethanol | Water |
| Example 5 | 5 | 30 | | 20 | 45 |
| Example 6 | 10 | 34 | | 20 | 36 |
| Example 7 | 15 | 32 | | 20 | 33 |
| Example 8 | 20 | 30 | | 10 | 40 |
| Example 9 | 20 | 25 | | 20 | 35 |
| Example 10 | 25 | 35 | | 10 | 30 |
| Example 11 | 25 | 30 | | 10 | 35 |
| Example 12 | 25 | 20 | | 15 | 40 |
| Example 13 | 30 | 15 | | 20 | 35 |
| Example 14 | 35 | 5 | | 25 | 35 |
| Example 15 | 25 | | 15 | 20 | 40 |
| Example 16 | 25 | | 20 | 15 | 40 |
| Example 17 | 20 | | 25 | 20 | 35 |

Comparative Example 7

According to the method described above with reference to FIG. 5, 11 wt % starch, 22 wt % maltodextrin, 20 wt % ethanol, and 80 wt % water were measured and mixed to prepare a coating composition, and the coating composition was used to manufacture a smoking article having the same specifications as the smoking article according to Example 5. For reference, the components and component ratio of the coating composition according to Comparative Example 7 are almost the same as those of a coating composition that is currently applied to commercially available products.

Experimental Example 6: Evaluation of Intermediate Extinguishing Rate of Coating Composition An experiment was conducted to evaluate an intermediate extinguishing rate of the smoking articles according to Comparative Example 7 and Examples 5 to 17. The intermediate extinguishing rate (%) was measured on the basis of the ISO-12863 ignition propensity measurement method, and the experimental results are shown in Table 8 below.

TABLE 8

| Classification | Intermediate extinguishing rate (%) |
|---|---|
| Comparative Example 7 | 80 |
| Example 5 | 30 |
| Example 6 | 50 |
| Example 7 | 70 |
| Example 8 | 90 |
| Example 9 | 100 |
| Example 10 | 80 |
| Example 11 | 80 |
| Example 12 | 90 |
| Example 13 | 90 |
| Example 14 | 75 |
| Example 15 | 90 |
| Example 16 | 90 |
| Example 17 | 100 |

Referring to Table 8, it can be seen that, in a case in which the content of Arabic gum is less than 10 wt % (e.g., Example 5), the intermediate extinguishing rate is less than 50%, and in a case in which the content of Arabic gum is higher than or equal to 10 wt % (e.g., Examples 6 to 14), the intermediate extinguishing rate is higher than or equal to 50%. From this, it can be seen that the content of Arabic gum being higher than or equal to 10 wt % is preferable.

Also, it can be seen that, in a case in which the content of Arabic gum is in a range of 15% to 30 wt % and the content of fructo-oligosaccharide or galacto-oligosaccharide is in a range of 5 wt % to 35 wt % (e.g., Examples 7 to 14), the intermediate extinguishing rate is higher than or equal to at least 70%. From this, it can be seen that the ignition propensity of the coating composition relating to cigarette paper can be significantly reduced when the content of Arabic gum and the content of fructo-oligosaccharide or galacto-oligosaccharide are within the above numerical ranges.

Also, the coating compositions according to Examples 8 to 17 were found to have a higher intermediate extinguishing rate than the coating composition according to Comparative Example 7. This shows that the coating composition in which Arabic gum and fructo-oligosaccharide (or galacto-oligosaccharide) are combined has a lower ignition propensity than the coating composition in which starch and maltodextrin are combined. In particular, considering that, in terms of workability, the coating composition in which Arabic gum and fructo-oligosaccharide are combined far exceeds the coating composition in which starch and maltodextrin are combined, it can be seen that the coating compositions according to the examples are far more superior to that according to the comparative example.

Experimental Example 7: Sensory Evaluation for Comparative Example 7 and Example 9

For the smoking articles according to Comparative Example 7 and Example 9, sensory evaluation was carried out by a panel of thirty evaluators. Seven evaluation items, including draw resistance, tobacco smoke taste intensity, and irritation, were set, and evaluation was performed based on a scale of 1 to 5. To reduce the evaluation error, the average of the scores given by the panel, excluding the lowest and highest scores, was calculated as the final score of the corresponding smoking article. The evaluation results are illustrated in FIG. 8.

Referring to FIG. 8, it can be seen that the results of sensory evaluation of the smoking article according to Example 9 are almost the same as those of the smoking article according to Comparative Example 7. This indicates that, even when the coating composition of existing smoking articles is changed to the coating composition according to Example 9, the smoking sensation felt by the smoker is hardly affected. Therefore, it can be seen that the coating composition according to the example improves the intermediate extinguishing rate of the smoking article and workability of manufacturing the smoking article while having almost no negative influence on the smoking sensation.

Experimental Example 8: Smoke Components Analysis for Comparative Example 7 and Example 9

For more objective and quantitative evaluation, smoke components analysis was performed for the smoking articles according to Comparative Example 7 and Example 9. Specifically, smoke components of mainstream smoke were analyzed during smoking of smoking articles manufactured two weeks beforehand. The smoke was repeatedly collected four times for each sample, based on eight puffs per time. The component analysis results were derived on the basis of the average values of three collection results. Also, smoking was performed according to Health Canada (HC) smoking conditions using a non-burning type automatic smoking device in a smoking room with a temperature of about 20° C. and humidity of about 62.5%. The component analysis results according to this experimental example are shown in Table 9 below.

TABLE 9

| | Components of smoke (mg/cig) | | | | | |
|---|---|---|---|---|---|---|
| Classification | TPM | Tar | Nic | CO | $CO_2$ | Moisture |
| Comparative Example 7 | 5.87 | 4.67 | 0.47 | 3.97 | 11.37 | 0.72 |
| Example 9 | 5.80 | 4.67 | 0.48 | 3.82 | 10.88 | 0.66 |

Referring to Table 9, it can be seen that the results of smoke components analysis for the smoking article according to Example 9 were almost the same as the results of smoke components analysis for the smoking article according to Comparative Example 7. In this way, it was objectively confirmed that the coating composition according to the example improves the intermediate extinguishing rate of the smoking article while having almost no negative influence on the smoking sensation.

The configurations and effects of the coating composition mentioned in the present disclosure have been described in detail above using examples and comparative examples.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. A coating composition of a low ignition propensity cigarette paper, the coating composition comprising:

Arabic gum;

ethanol;

water;

fructo-oligosaccharide or galacto-oligosaccharide; and one or more of citric acid, tartaric acid, lactic acid, malic acid, and ascorbic acid, wherein the Arabic gum is included in an amount in a range of 10 wt % to 30 wt %, the ethanol is included in an amount in a range of 15 wt % to 30 wt %, the water is included in an amount in a range of 10 wt % to 40 wt %, the fructo-oligosaccharide or the galacto-oligosaccharide is included in an amount in a range of 5 wt % to 35 wt %, and a viscosity of the coating composition is higher than or equal to 20 cPs and less than 1,000 cPs.

2. A method of manufacturing a low ignition propensity cigarette paper, the method comprising:

preparing the coating composition of claim 1;

applying the coating composition to a specific region of cigarette paper; and heating and drying the cigarette paper, to which the coating composition is applied, such that a coating portion is formed.

3. A smoking article comprising:

a smoking material portion including:

a cigarette paper which includes one or more coating portions formed using the coating composition of claim 1; and a smoking material which is wrapped with the cigarette paper; and a filter portion.

4. The smoking article of claim 3, wherein:

the coating portion includes a first coating portion and a second coating portion;

the smoking material portion includes a first segment disposed within a predetermined distance from an end portion adjacent to the filter portion and a second segment disposed at a greater distance therefrom than the first segment;

the first coating portion is formed in a region of the cigarette paper that corresponds to the first segment, and the second coating portion is formed in a region of the cigarette paper that corresponds to the second segment; and an amount of the coating composition included in the first coating portion is larger than an amount of the coating composition included in the second coating portion.

5. The smoking article of claim 4, wherein a viscosity of the coating composition applied to the first coating portion is higher than a viscosity of the coating composition applied to the second coating portion.

6. The smoking article of claim 4, wherein a combustion improver is applied to the region of the cigarette paper that corresponds to the second segment.

7. The coating composition of claim 1, comprising one or more of citric acid, tartaric acid, lactic acid, and malic acid.

8. The coating composition of claim 1, wherein the coating composition does not comprise sodium benzoate.

9. The coating composition of claim 1, comprising one or more of tartaric acid, lactic acid, malic acid, and ascorbic acid.

* * * * *